US011999523B1

(12) United States Patent
Orr

(10) Patent No.: US 11,999,523 B1
(45) Date of Patent: Jun. 4, 2024

(54) DEVICE FOR MANIPULATING AN OBJECT

(71) Applicant: Tomothy E. Orr, Redding, CA (US)

(72) Inventor: Tomothy E. Orr, Redding, CA (US)

(73) Assignee: TORR INDUSTRIES, INC., Redding, CA (US)

( * ) Notice: Subject to any disclaimer, the term of this patent is extended or adjusted under 35 U.S.C. 154(b) by 0 days.

(21) Appl. No.: 17/713,892

(22) Filed: Apr. 5, 2022

(51) Int. Cl.
*B65B 7/28* (2006.01)
*B65B 59/00* (2006.01)

(52) U.S. Cl.
CPC ..... *B65B 7/28* (2013.01); *B65B 59/00* (2013.01)

(58) Field of Classification Search
CPC ..... B65B 7/28; B65B 59/00; B65B 59/001; B65B 59/02; B65B 59/04; B65B 7/2807; B65B 7/2835; B67B 3/2066; B67B 3/2033; B67B 3/28
See application file for complete search history.

(56) References Cited

U.S. PATENT DOCUMENTS 4,674,263 A * 6/1987 Kelly ..... B67B 3/2066 53/317
6,176,617 B1 * 1/2001 Kamimura ..... F16C 29/086 384/13
2018/0354765 A1 * 12/2018 Schoenfelder ..... B67B 3/2066

* cited by examiner

*Primary Examiner* — Veronica Martin
(74) *Attorney, Agent, or Firm* — Theodore J. Bielen, Jr.

(57) ABSTRACT

A device for manipulating an object, utilizing a pair of opposed legs that are rotatably connected to a pair of plates. The legs are rotated via a pair of contracting and expanding units. The units are mechanically linked to the first and second legs and the first and second legs are enabled to grip an object when the units contract.

12 Claims, 5 Drawing Sheets

DEVICE FOR MANIPULATING AN OBJECT

BACKGROUND OF THE INVENTION

The present application relates to a novel and useful device for manipulating an object, such as a stopper or cap, that is employed with containers.

Portable liquids, such as wine, juice, milk, and the like are often packaged in containers such as flexible pouches or bags. During the filling process of such containers, it is necessary to enclose the same with a cap or stopper.

In the past, caps or stoppers have been placed manually or through the use of automatic devices that utilize complicated mechanisms employing elements such as ball bearings. Unfortunately, the contents of such containers often spill or migrate onto devices that are utilized for capping containers such as plastic pouches. Such spillage often causes fouling of the capping devices and is a source of contamination in the filling process.

A reliable capping device for liquid containers that is easily lubricated and cleaned would be a notable advance in the liquid processing industries.

SUMMARY OF THE INVENTION

In accordance with the present application, a novel and useful device for manipulating an object, such as a cap for a container, is herein provided.

The device of the present application includes a pair of legs that are mounted to opposing plates in order to position the first and second legs in opposition to each other. The first and second legs are rotatable relative to the first and second plates. Each leg includes a first end portion having a compartment with an internal passageway. At least a pair of apertures communicates with the internal passageway and the exterior of the compartment of the first leg. Such apertures allow for the flushing and circulation of lubricants and cleaning fluids about a rotational mechanism.

The first leg further includes a second end portion that possesses an end surface. The end surface may be part of an extension of an angular element. The second leg is similarly constructed.

A motivating mechanism is linked to the first and second legs to rotate the first and second legs and, thus, move the spaced opposed end surfaces of the first and second legs toward one another. Such motion is used to engage or grip the object, which may be a cap. The motivating mechanism may take the form of a pair of pneumatic muscles with one pneumatic muscle connected to one leg and another pneumatic muscle connected to the other leg. A rotational mechanism in the compartment portion of each leg includes a spring which permits the first and second legs to separate following engagement or gripping of the object.

It may be apparent that a novel and useful device for manipulating an object, such a cap, has been hereinabove described.

It is therefore an object of the present application to provide a device for manipulating an object which is relatively simple to manufacture and maintain and reliably grips an object.

Another object of the present application is to provide a device for manipulating an object in which first and second legs are rotatably moved toward one another to grip a cap, which is employed with liquid containers.

Another object of the present application is to provide a device for manipulating an object in which a cap is gripped and may be employed in an assembly line for filling plastic pouches.

Another object of the present application is to provide a device for manipulating an object which may be employed with potable liquids and is easily flushed and lubricated should such portable liquids come in contact with the rotational mechanism of the device.

Another object of the present application is to provide a device for manipulating an object which may be constructed for reliable repeated use in a liquid filling operation.

The application possesses other objects and advantages, especially as concerns particular characteristics and features thereof which will become apparent as the specification continues.

Figure 1:
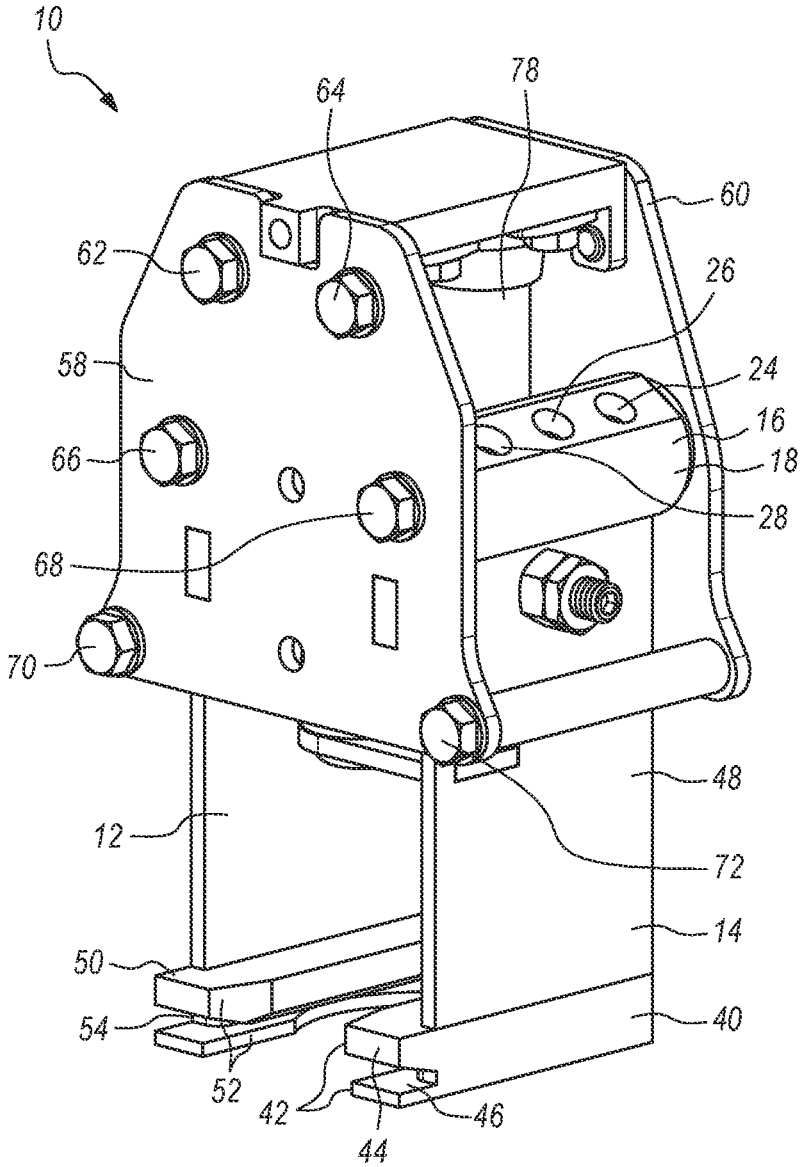
FIG. 1 is a top right perspective view of the device of the present application.

For a better understanding of the application, reference is made to the following detailed description of the preferred embodiments which should be referenced to the prior delineated drawings.

DETAILED DESCRIPTION OF THE PREFERRED EMBODIMENTS

Various aspects of the present application will evolve from the following detailed description of the preferred embodiments thereof which should be referenced to the prior delineated drawings.

The device of the present application as a whole is depicted in the drawings by reference character 10.

Figure 5:
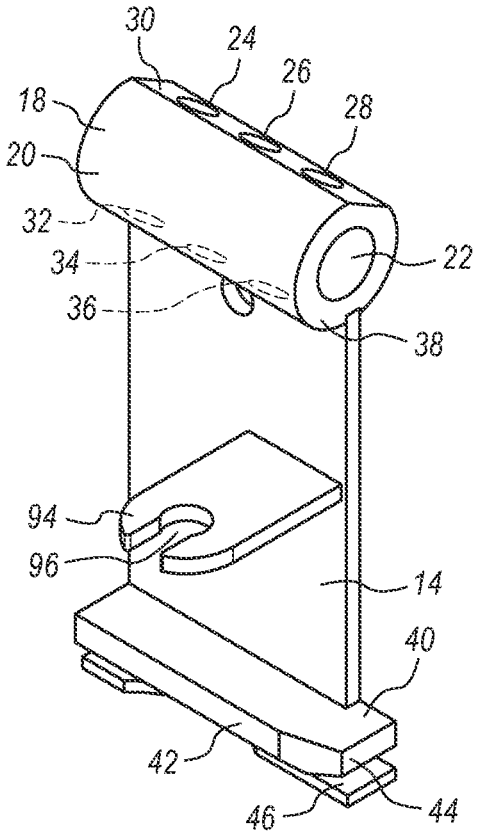
FIG. 5 is a perspective view of a leg used in the device of the present application.

Viewing FIG. 1, it may be observed that device 10 for manipulating an object includes a pair of legs 12 and 14 that are positioned opposite one another. With further reference to leg 14, it should be understood that leg 12 is similarly constructed and, thus, the details with respect to leg 14 also apply to leg 12. Again referring to FIG. 1, it may be seen that leg 14 is formed with a first end portion 16 having a compartment 18. With reference to FIG. 5, it may be apparent that leg 14 compartment 18 is formed with an exterior 20 and an internal passageway 22. Apertures 24, 26, and 28 communicate with passageway 22 at the upper portion 30 of compartment 18. In addition, apertures 32, 34, and 36 communicate with passageway 22 through the lower portion 38 of compartment 18 of leg 14. Apertures 24, 26, and 28 in combination with apertures 32, 34, and 36 allow the flow of flushing liquids and lubricants to the internal passageway 22. First leg 14 is also formed with a second end portion 40. Second end portion 40 includes an end surface 42 which is part of an angular element 44 and includes a slot 46, best shown in FIGS. 1, 3, and 5. Intermediate portion 48 of leg 14 lies between first end portion 16 and second end portion 40 of leg 14. It should be noted that first leg 12 end portion 50 is also formed with an end surface 52 with a slot 54, FIG. 1. Needless to say, leg 12 is also constructed with a compartment 56, which is similar to compartment 18 of second leg 14.

Figure 3:
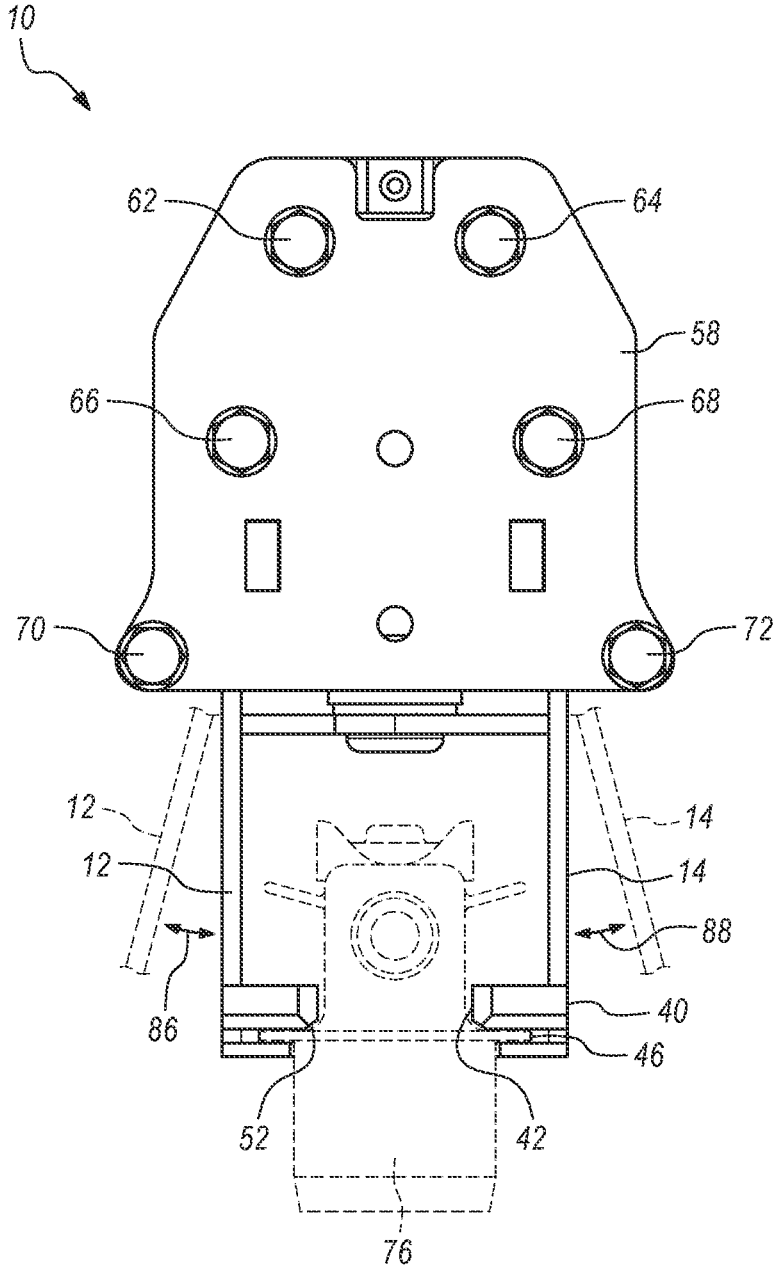
FIG. 3 is a front elevational view of the device of the present application.
Figure 4:
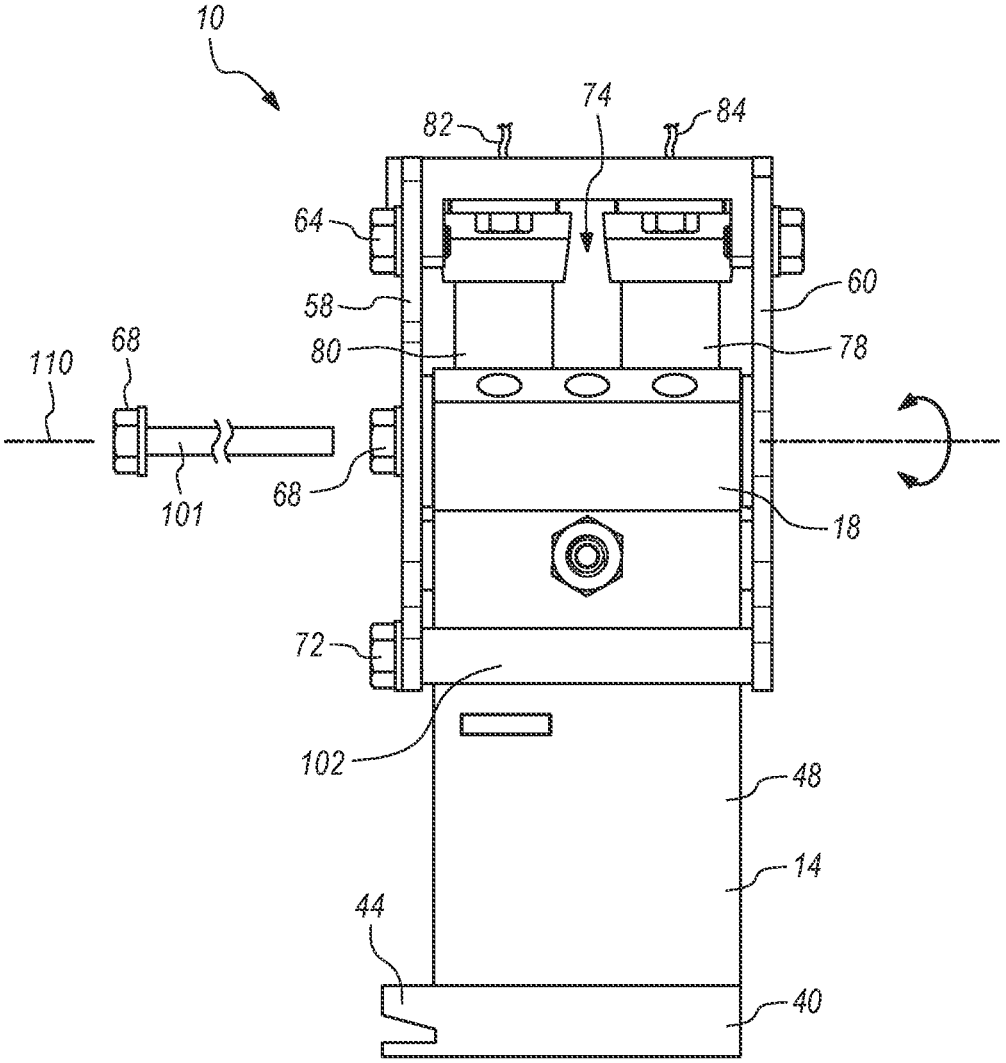
FIG. 4 is a side elevational view of the device of the present application.

Device 10 is also fashioned with first plate 58 and second plate 60, which are opposed and separated from one another, FIGS. 1 and 4. First and second plates 58 and 60 are connected to one another via through bolts 62, 64, 66, 68, 70, and 72, FIGS. 1 and 3. First and second legs 12 and 14 are rotatably attached to first and second plates 58 and 60 such that first and second legs 12 and 14 are spaced from each other and such that end surface 42 of leg 14 lies in spaced opposition to end surface 52 of leg 12, FIG. 3.

Figure 6:
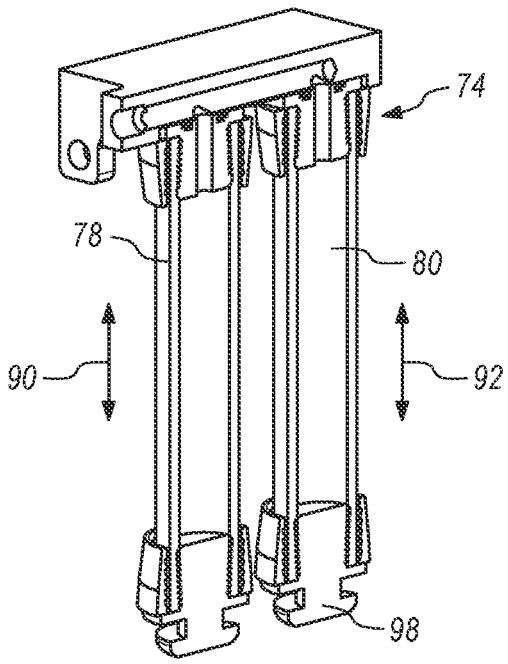
FIG. 6 is a perspective view of the motivating mechanism in the form of a pair of pneumatic muscles shown in cutaway view.

The rotational connection of legs 12 and 14 to opposed plates 58 and 16 is further shown on FIGS. 4 and 6 where an exemplary through bolt 68 includes a shaft 101 which extends through internal passageway 22 of compartment 18 of leg 14. Spring 100 biases leg 14 outwardly toward stop 102 and an elastomeric bushing 104 aids in the smooth rotation of leg 14. Of course, the same structure exists with respect to leg 12, which acts in concert with stop 106. Axes 108 and 110, FIG. 2, illustrate the rotational reference for legs 12 and 14.

A motivation mechanism 74 is linked to legs 12 and 14 in order to rotate legs 12 and 14 and spaced and opposed end surfaces 52 and 42, respectively, toward one another. Such movement of legs 12 and 14 are intended to engage or grip an object 76, which may take the form of a container cap normally employed to enclose containers having a liquid fill, FIG. 3. Motivating mechanism 74 is preferably shown as expanding and contracting units 78 and 80. Expanding and contracting units 78 and 80 may externalize in pneumatic muscles that are motivated electrically, receiving power via conductors 82 and 84, respectively, FIG. 4. Expanding and contracting units 78 and 80 are linked to first and second legs 12 and 14 such that such expansion and contracting causes the rotation of legs 12 and 14. Specifically, when expanding and contracting units 78 and 80 contract, legs 12 and 14 will move toward one another such that end surfaces 52 and 42 of legs 12 and 14 engage and grip object 76, as shown in FIG. 3. Directional arrows 86 and 88 indicate the rotational movement of legs 12 and 14 in this regard. Likewise, directional arrows 90 and 92 of FIG. 6 indicate the expansion and contracting of units 78 and 80.

Figure 2:
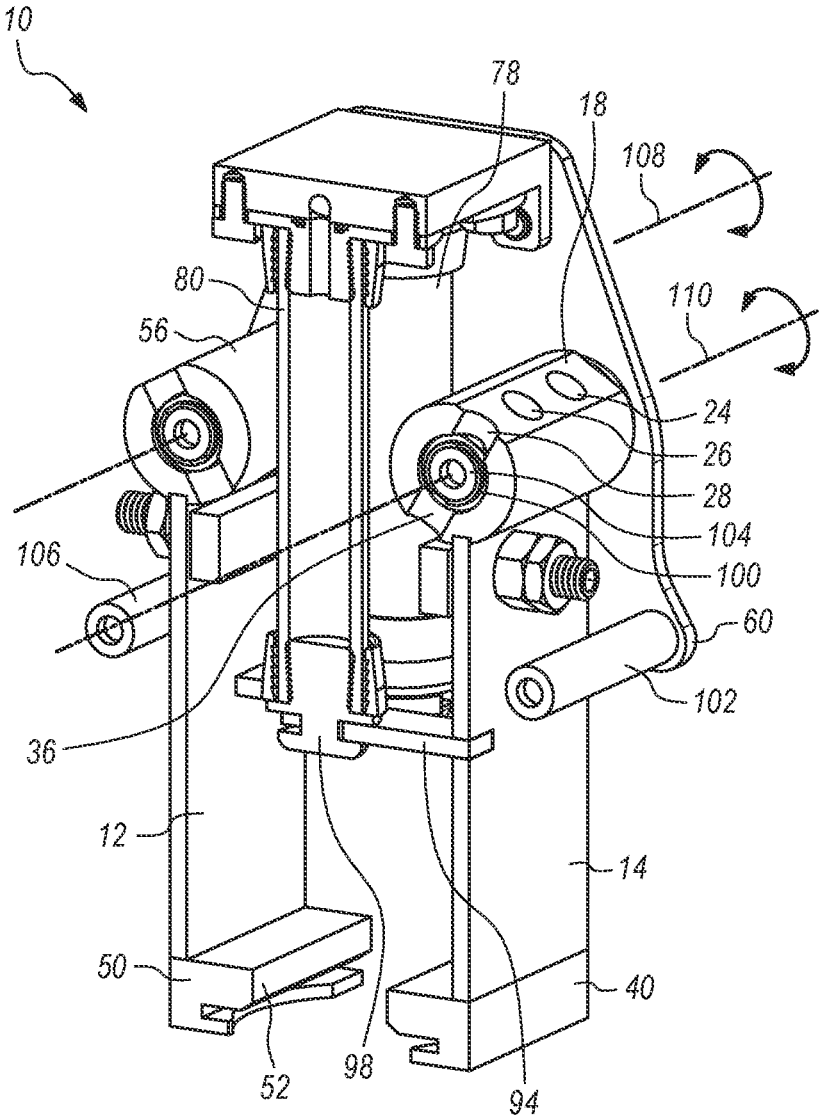
FIG. 2 is a partial perspective view in which the front portion of the device shown in FIG. 1 has been removed.

Turning now to FIGS. 2 and 5, the linking of legs 12 and 14 to units 78 and 80 is illustrated with reference to leg 14 and expanding and contracting unit 78. Of course, the same structure shown on leg 12 and unit 80 are present in device 10. Leg 14 includes a tongue 94 having an open slot 96 which engages an approximately T-shaped end portion 98 of expanding and contracting unit 80.

As heretofore stated, apertures 24, 26, 28, 32, 34, and 36 permit the application and flow of flushing liquids and lubricants to ensure the smooth rotation of legs 12 and 14.

In operation, legs 12 and 14 are mounted between plates 58 and 60 and are allowed to rotate relative thereto. Motivation mechanism 74 in the form of expanding and contracting units 78 and 80 are linked to legs 12 and 14 by the use of a typical tongue 94 and T-shaped end portion 98, shown with respect to leg 14 on FIGS. 2, 5, and 6. Once electrical power is applied to electrical conductors 82 and 84, expanding and contracting units 78 and 80 contract, causing the rotation of legs 12 and 14 toward one another, as depicted in FIG. 3. Such motion grips object 76, by the contact of end surfaces 52 and 42 of legs 12 and 14. Once the electrical power is removed from conductors 82 and 84, springs, such as exemplar spring 100 with respect to leg 14, rotate legs 12 and 14 outwardly to stops 106 and 102, respectively. Such outward movement is illustrated in phantom on FIG. 3. Such rotational motion also releases object 76 which is then employed to enclose a container (not shown). Flushing liquids and lubricants are easily applied to compartment 18 of leg 14 and compartment 45 of leg 12 to ensure reliable rotation of legs 12 and 14, via apertures thereat.

While in the foregoing, embodiments of the application have been set forth in considerable detail for the purposes of making a complete disclosure of the application, it may be apparent to those of skill in the art that numerous changes may be made in such details without departing from the spirit and principles of the application.

What is claimed is:

1. A device for manipulating an object, comprising:

a first leg, said first leg comprising a first end portion having a compartment, said compartment of said first leg further comprising a wall having an exterior and an internal passageway with at least a pair of apertures extending through said wall from said exterior of said compartment to said internal passageway, said pair of apertures communicating with said internal passageway and said exterior of said compartment of said first leg, said pair of apertures further being configured to permit a flushing by liquids through said internal passageway, said first leg further comprising a second end portion, said second end portion including an end surface, said first leg further comprising an intermediate portion between said first and second end portions;

a second leg, said second leg comprising a first end portion having a compartment, said second leg further comprising a second end portion, said second end portion of said second leg including an end surface, said second leg further comprising an intermediate portion between said first and second end portions;

first and second plates, said first and second plates being opposed and separated from one another, said first and second legs being rotatably attached to said first and second plates, respectively, at least a rotational attachment of said first leg to said first plate comprising a shaft extending through said internal passageway of said compartment of said first leg, said first and second legs being positioned spaced from each other to allow said end surfaces of said second end portions of said first and second legs to lie in spaced opposition to one another; and a motivating mechanism linked to said first and second legs to rotate said first and second legs to move said end surfaces of said first and second legs toward one another to engage the object.

2. The device of claim 1 in which said first and second plates are connected to one another and to said motivating mechanism.

3. The device of claim 2 which additionally comprises a first stop for limiting rotation of said first leg and a second stop for limiting rotation of said second leg, said first and second stops each being fastened to said first and second plates.

4. The device of claim 1 in which said second end portions of said first and second legs further each comprise angular elements, said angular elements of said second end portions of said first and second legs each including said end surfaces of said first and second legs, respectively.

5. The device of claim 1 in which the object comprises a container cap and said end surfaces of said first and second legs simultaneously engage the container cap.

6. The device of claim 1 in which said motivating mechanism comprises a first expanding and contracting unit linked to said first leg and a second expanding and contracting unit linked to said second leg.

7. The device of claim 6 in which at least said first expanding and contracting unit linked to said first leg comprises pneumatic muscle that contracts to effect rotation of said end surface of said of said first leg toward the object.

8. The device of claim 7 in which said second expanding and contracting unit linked to said second leg comprises a pneumatic muscle that contracts to effect rotation of said end surface of said second leg toward the object.

9. The device of claim 6 in which said first and second opposed plates are connected to one another and to said motivating mechanism.

10. The device of claim 9 which additionally comprises a first stop for limiting rotation of said first leg and a second stop for limiting rotation of said second leg, said first and second stops each being fastened to said first and second plates.

11. The device of claim 6 in which said second end portions of said first and second legs further each comprise angular elements, said angular elements of said second end portions of said first and second legs each including said end surfaces of said first and second legs, respectively.

12. The device of claim 6 in which the object comprises a container cap and said end surfaces of said first and second legs simultaneously engage the container cap.

* * * * *